US008761644B2

(12) United States Patent
Matsuzaki

(10) Patent No.: US 8,761,644 B2
(45) Date of Patent: Jun. 24, 2014

(54) DEVELOPMENT UNIT AND IMAGE FORMING APPARATUS USING THE SAME

(75) Inventor: Koichi Matsuzaki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 331 days.

(21) Appl. No.: 13/215,508

(22) Filed: Aug. 23, 2011

(65) Prior Publication Data

US 2012/0063817 A1 Mar. 15, 2012

(30) Foreign Application Priority Data

Sep. 13, 2010 (JP) ..... 2010-204385

(51) Int. Cl.
*G03G 15/08* (2006.01)

(52) U.S. Cl.
USPC ..... 399/272; 399/271

(58) Field of Classification Search
USPC ..... 399/272, 281
See application file for complete search history.

(56) References Cited

U.S. PATENT DOCUMENTS 8,045,903 B2 * 10/2011 Shouno et al. ..... 399/281
8,116,668 B2 * 2/2012 Koyanagi et al. ..... 399/281
2009/0324302 A1 * 12/2009 Matsumoto ..... 399/285

FOREIGN PATENT DOCUMENTS

JP 2009-020224 A 1/2009

* cited by examiner

*Primary Examiner* — Clayton E Laballe
*Assistant Examiner* — Leon W Rhodes, Jr.
(74) *Attorney, Agent, or Firm* — Marvin A. Motsenbocker; Mots Law, PLLC

(57) ABSTRACT

A development unit including: a developer carrier configured to carry a developer, and capable of supplying the carried developer to an electrostatic latent image; and a developer supplying member configured to supply the developer to the developer carrier and having a surface thereof made of a foamed body. Relationships expressed by $v<S/10$ and $S/Dv\leq125$ are satisfied, where a cell opening size of the foamed body is S [μm], a volume mean particle diameter of the developer is Dv [μm], and a volume ratio of particles having a particle diameter of 5 [μm] or less to the total developer is v [%].

18 Claims, 7 Drawing Sheets

FIG. 6

| | PARTICLE DIAMETER DV [μm] | TONER | 5 μm OR LESS v [%] | SPONGE ROLLER | CELL OPENING S [μm] | STAIN | S/10 | S/Dv |
|---|---|---|---|---|---|---|---|---|
| Comparative Example 1-1 | 7.2 | A | 30.5 | α | 300 | X | 30 | 41.7 |
| Example 1-1 | | B | 8.7 | | | ○ | | |
| Example 1-2 | | A | 30.5 | β | 600 | ○ | 60 | 83.3 |
| Example 1-3 | | B | 8.7 | | | ○ | | |
| Example 1-4 | | A | 30.5 | γ | 900 | ○ | 90 | 125.0 |
| Example 1-5 | | B | 8.7 | | | ○ | | |
| Comparative Example 1-2 | 6.3 | C | 31.0 | α | 300 | X | 30 | 47.6 |
| Example 1-6 | | D | 10.8 | | | ○ | | |
| Example 1-7 | | C | 31.0 | β | 600 | ○ | 60 | 95.2 |
| Example 1-8 | | D | 10.8 | | | ○ | | |
| Comparative Example 1-3 | | C | 31.0 | γ | 900 | X | 90 | 142.9 |
| Comparative Example 1-4 | | D | 10.8 | | | X | | |
| Comparative Example 1-5 | 5.7 | E | 32.3 | α | 300 | X | 30 | 52.6 |
| Example 1-9 | | F | 25.4 | | | ○ | | |
| Example 1-10 | | E | 32.3 | β | 600 | ○ | 60 | 105.3 |
| Example 1-11 | | F | 25.4 | | | ○ | | |
| Comparative Example 1-6 | | E | 32.3 | γ | 900 | X | 90 | 157.9 |
| Comparative Example 1-7 | | F | 25.4 | | | X | | |

FIG. 7

| | PARTICLE DIAMETER DV [μm] | TONER | 5 μm OR LESS v [%] | SPONGE ROLLER | CELL OPENING S [μm] | STAIN | S/10 | S/Dv |
|---|---|---|---|---|---|---|---|---|
| Comparative Example 2-1 | 7.3 | G | 30.2 | α | 300 | X | 30 | 41.1 |
| Example 2-1 | | H | 8.5 | | | ○ | | |
| Example 2-2 | | G | 30.2 | β | 600 | ○ | 60 | 82.2 |
| Example 2-3 | | H | 8.5 | | | ○ | | |
| Example 2-4 | | G | 30.2 | γ | 900 | ○ | 90 | 123.3 |
| Example 2-5 | | H | 8.5 | | | ○ | | |
| Comparative Example 2-2 | 6.0 | I | 30.9 | α | 300 | X | 30 | 50.0 |
| Example 2-6 | | J | 11.3 | | | ○ | | |
| Example 2-7 | | I | 30.9 | β | 600 | ○ | 60 | 100.0 |
| Example 2-8 | | J | 11.3 | | | ○ | | |
| Comparative Example 2-3 | | I | 30.9 | γ | 900 | X | 90 | 150.0 |
| Comparative Example 2-4 | | J | 11.3 | | | X | | |
| Comparative Example 2-5 | 5.5 | K | 31.5 | α | 300 | X | 30 | 54.5 |
| Example 2-9 | | L | 22.1 | | | ○ | | |
| Example 2-10 | | K | 31.5 | β | 600 | ○ | 60 | 109.1 |
| Example 2-11 | | L | 22.1 | | | ○ | | |
| Comparative Example 2-6 | | K | 31.5 | γ | 900 | X | 90 | 163.6 |
| Comparative Example 2-7 | | L | 22.1 | | | X | | |

DEVELOPMENT UNIT AND IMAGE FORMING APPARATUS USING THE SAME

CROSS REFERENCE TO RELATED APPLICATIONS

This application claims priority based on 35 USC 119 from prior Japanese Patent Application No. 2010-204385 filed on Sep. 13, 2010, entitled "DEVELOPMENT UNIT AND IMAGE FORMING APPARATUS USING THE SAME", the entire contents of which are incorporated herein by reference.

BACKGROUND OF THE INVENTION

1. Field of the Invention

The invention relates to a development unit and an image forming apparatus using the same.

2. Description of the Related Art

In general electrophotography includes: a charging step of uniformly charging a photoconductive insulating layer; a light-exposure step of exposing the layer to light, and forming an electrostatic latent image by eliminating electric charges on a part of the layer exposed to light; a development step of making the formed electrostatic latent image visible by causing a developer, which includes at least a coloring agent, to adhere to the formed electrostatic latent image; a transfer step of transferring the obtained visible image onto a transfer medium such as a transfer sheet; and a fixing step of fixing the visible image to the transfer medium by heating and pressing, or by any other appropriate fixing method. Incidentally, the development step includes: a developer supplying step of supplying the developer to a developer carrier.

Japanese Patent Application Publication No. 2009-20224 describes a technology for extending the life of a development unit by specifying: a ratio of free external additive added to the developer; a surface roughness of the developer carrier; and a rotational circumferential speed of the developer carrier.

SUMMARY OF THE INVENTION

The technology described in Japanese Patent Application Publication No. 2009-20224 aims at extending the life of the development unit with attention paid to only the developer carrier.

However, the foregoing conventional development unit may deteriorate the image quality with time.

With this taken into consideration, an object of an embodiment of the invention is to improve the image quality.

An aspect of the invention is a development unit including: a developer carrier configured to carry a developer, and capable of supplying the carried developer to an electrostatic latent image; and a developer supplying member configured to supply the developer to the developer carrier and having a surface thereof made of a foamed body. Relationships expressed by $v<S/10$ and $S/Dv\leq 125$ are satisfied, where the cell opening size of the foamed body is S [μm], the volume mean particle diameter of the developer is Dv [μm], and the volume ratio of particles having a particle diameter of 5 [μm] or less to the total developer is v [%].

The aspect improves image quality.

BRIEF DESCRIPTION OF THE DRAWINGS

FIG. 6 shows a result of evaluating combinations of toners and supply rollers which are used in Example 1.

FIG. 7 shows a result of evaluating combinations of toners and supply rollers which are used in Example 2.

DETAILED DESCRIPTION OF THE PREFERRED EMBODIMENTS

Figure 1:
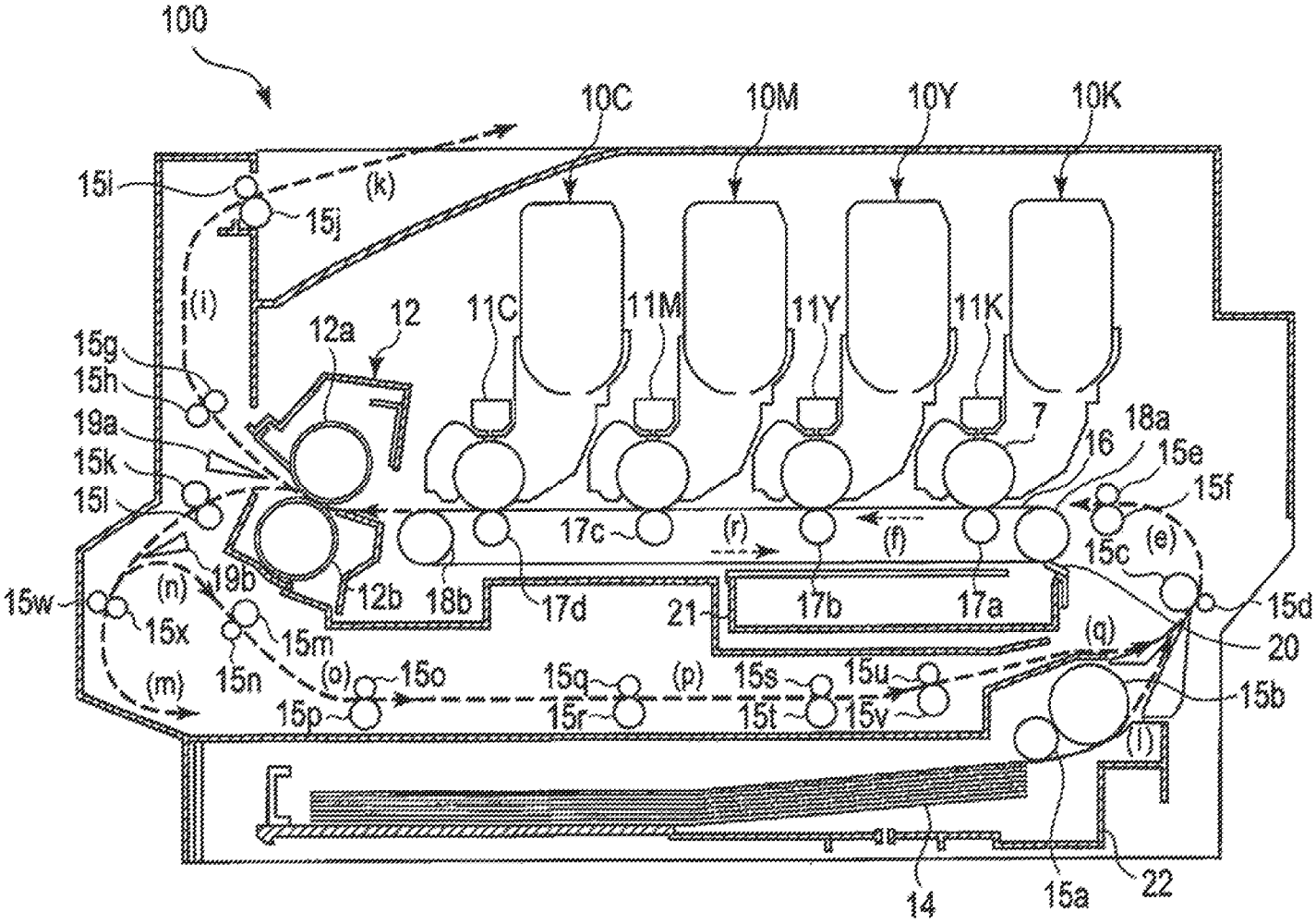
FIG. 1 is a diagram of a configuration of an image forming apparatus of an embodiment of the invention.

Descriptions are provided herein below for embodiments based on the drawings. In the respective drawings referenced herein, the same constituents are designated by the same reference numerals and duplicate explanation concerning the same constituents is omitted. All of the drawings are provided to illustrate the respective examples only.

The inventor find that, when the cell openings in a sponge roller (developer supplying member) are clogged with the developer, an undeveloped portion of the toner which remains on the development roller (developer carrier) cannot be scraped off, and the remaining portion of the toner accordingly causes a stain on the printing medium. In addition, the inventors arrive at a technology for making the stain less likely to take place on the printing medium by making the cell openings of the sponge roller (developer supplying member) less likely to be clogged with the developer. Descriptions are hereinbelow provided for embodiments.

First Embodiment (Description of Configuration)

FIG. 1 is a diagram of a configuration of an image forming apparatus of an embodiment of the invention.

In FIG. 1, image forming apparatus 100 is a tandem color printing apparatus capable of printing electrophotographic images on both sides of recording sheet 14. Image forming apparatus 100 includes: four development units 10 (10K, 10Y, 10M, 10C); four LED heads (11K, 11Y, 11M, 11C); fixing unit 12; four transfer rollers 17 (17*a*, 17*b*, 17*c*, 17*d*) as a transfer unit; transfer belt 16; recording-sheet conveying rollers 15 (15*a*, 15*b*, . . . , 15*v*) as a medium conveying mechanism; drive rollers 18*a*, 18*b*; recording-sheet running guides 19*a*, 19*b*; transfer-belt cleaning blade 20; waste developer tank 21; and recording-sheet cassette 22. Incidentally, fixing unit 12 includes heating roller 12*a* and pressure roller 12*b*. In addition, the letters K, Y, M, and C used to denote colors correspond to black, yellow, magenta and cyan, respectively.

As development units 10, development units 10K, 10Y, 10M, 10C for the respective four colors, each of which is filled with a toner as a developer, are arranged in a transfer direction (f). Each development unit develops an electrostatic latent image which is formed by light exposure, and thus forms a developer image. Development units 10 are later described by use of FIG. 3. LED heads 11 are multiple single-crystal thin-film light-emitting elements arranged in a line. In accordance with print data, each LED head 11 exposes photosensitive drum 7 (FIG. 3) to light, and forms the electrostatic latent image.

Transfer rollers 17*a*, 17*b*, 17*c*, 17*d* transfer the developer images, which are respectively formed inside development units 10, onto recording sheet 14 as a printing medium. Fixing unit 12 fixes the developer images, which are transferred onto recording sheet 14, by: heating the developer images to a predetermined temperature; and pressing the developer images. Incidentally, fixing unit 12 is covered with a fixing case so that the heat produced inside fixing unit 12 does not escape to the outside.

Recording-sheet cassette 22 contains one or more recording sheet 14. Recording-sheet conveying rollers 15 convey recording sheet 14 from recording-sheet cassette 22 to a delivery stacker. Transfer belt 16 is a belt member formed in an endless shape, and conveys recording sheet 14 to fixing unit 12. Drive rollers 18*a*, 18*b* are conveying members configured to drive transfer belt 16, and additionally function as cooling members configured to cool transfer belt 16, which is warmed by fixing unit 12. It should be noted that drive roller 18*b* is a driving roller while drive roller 18*a* is a driven roller. Recording-sheet running guides 19*a*, 19*b* are configured to provide rotational displacement in order to change the direction in which recording sheet 14 runs. Transfer-belt cleaning blade 20 is provided under (or beside) drive roller 18*a*, and waste developer tank 21 is provided under drive roller 18*a* and transfer belt 16.

It should be noted that parenthesized lowercase letters accompanied with the respective dashed thick/thin lines in FIG. 1 indicate a conveyance route of recording sheet 14 not only in the single-sided printing mode but also in the double-sided printing mode. To put it specifically, recording sheet 14 starts at recording-sheet cassette 22, passes route 1 via recording-sheet conveying rollers 15*a*, 15*b*, reaches recording-sheet conveying rollers 15*c*, 15*d*, further passes through conveyance route e, and reaches recording-sheet conveying rollers 15*e*, 15*f*. Thereafter, while recording sheet 14 is being conveyed along the top surface of transfer belt 16, development units 10 and transfer rollers 17 transfer their respective developer images onto the top surface of recording sheet 14. Subsequently, resultant recording sheet 14 passes through fixing unit 12.

In the case of the double-sided printing mode, recording sheet 14 is directed toward recording-sheet conveying rollers 15*k*, 15*l* by recording-sheet running guide 19*a*. Because of the working of recording-sheet running guide 19*b*, recording sheet 14 passes through recording-sheet conveying rollers 15*w*, 15*x* (conveyance route m). Subsequently, the reverse rotation of recording-sheet conveying rollers 15*w*, 15*x*, which hold the trailing edge of recording-sheet 14 in between, and recording-sheet running guide 19*b*'s change of the direction of recording sheet 14, cause recording sheet 14 to pass through conveyance route n, and reach recording-sheet conveying rollers 15*m*, 15*n*. Thereafter, recoding sheet 14 passes through conveyance routes o, p, q, and again reaches recording-sheet conveying rollers 15*c*, 15*d*. At this time, recording sheet 14 which is turned over passes through conveyance route e and recording-sheet conveying rollers 15*e*, 15*f*, and reaches transfer belt 16. Afterward, development units 10 and transfer rollers 17 transfer their respective developer images on the back surface of recording sheet 14, and fixing unit 12 fixes the developer images, which are thus transferred onto recording sheet 14.

Subsequently, the rotational movement of recording-sheet running guide 19*a* directs recording sheet 14 toward recording-sheet conveying rollers 15*g*, 15*h*. Thereafter, recording sheet 14 passes through conveyance rout i, reaches recording-sheet conveying rollers 15*i*, 15*j*, passes through conveyance route k, and is discharged.

Figure 2:
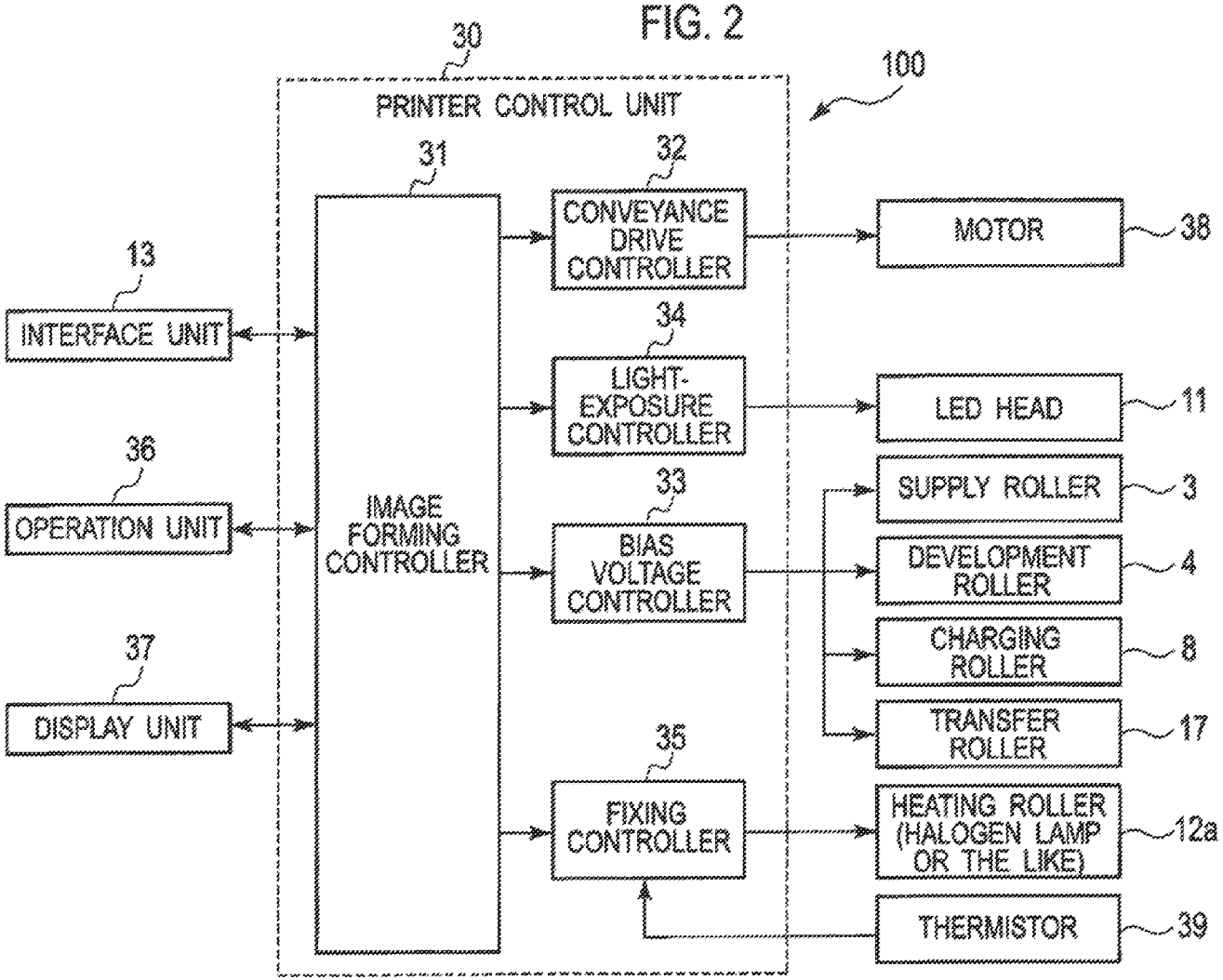
FIG. 2 is a block diagram of the configuration of the image forming apparatus of the embodiment of the invention.

FIG. 2 is a block diagram showing the configuration of image forming apparatus 100, inclusive of a printer control unit.

Image forming apparatus 100 includes: image forming controller 31; motor 38 configured to rotate recording-sheet conveying rollers 15, drive rollers 18*a*, 18*b* and the like; conveyance drive controller 32 configured to drive motor 38; bias voltage controller 33 configured to apply predetermined bias voltages to charging rollers 8, development rollers 4 and transfer rollers 17 (for example, to apply −1000V to charging rollers 8, −200V to development rollers 4, −300V to supply rollers 3, and +2500 to transfer rollers 17 in order to set the surface potential of photosensitive drums 7 at −600V); light-exposure controller 34 configured to control light emission of LED heads 11; fixing controller 35 configured to control the temperature of heating roller 12*a* by supplying electric power to a halogen lamp or something similar inside heating roller 12*a*; thermistor 39 configured to control the feedback to fixing controller 35 by measuring the temperature of heating roller 12*a*; interface unit 13; operation unit 36; and display unit 37. Incidentally, image forming controller 31, conveyance drive controller 32, bias voltage controller 33, light-exposure controller 34 and fixing controller 35 constitute the printer control unit.

Image forming controller 31 converts the print data, which image forming controller 31 receives from interface unit 13, to bitmap data, and light-exposure controller 34 controls the light emission of LED heads 11. In addition, image forming controller 31 controls conveyance drive controller 32, bias voltage controller 33, and fixing controller 35. Furthermore, on the basis of operations from operation unit 36, image forming controller 31 makes various setups, and causes display unit 37 to display an operational status and an image forming status.

Motor 38 is used by recording-sheet conveying rollers 15, drive rollers 18, 18*b*, photosensitive drums 7, and fixing unit 12. A three-phase brushless motor or a stepping motor is used as motor 38.

Figure 3:
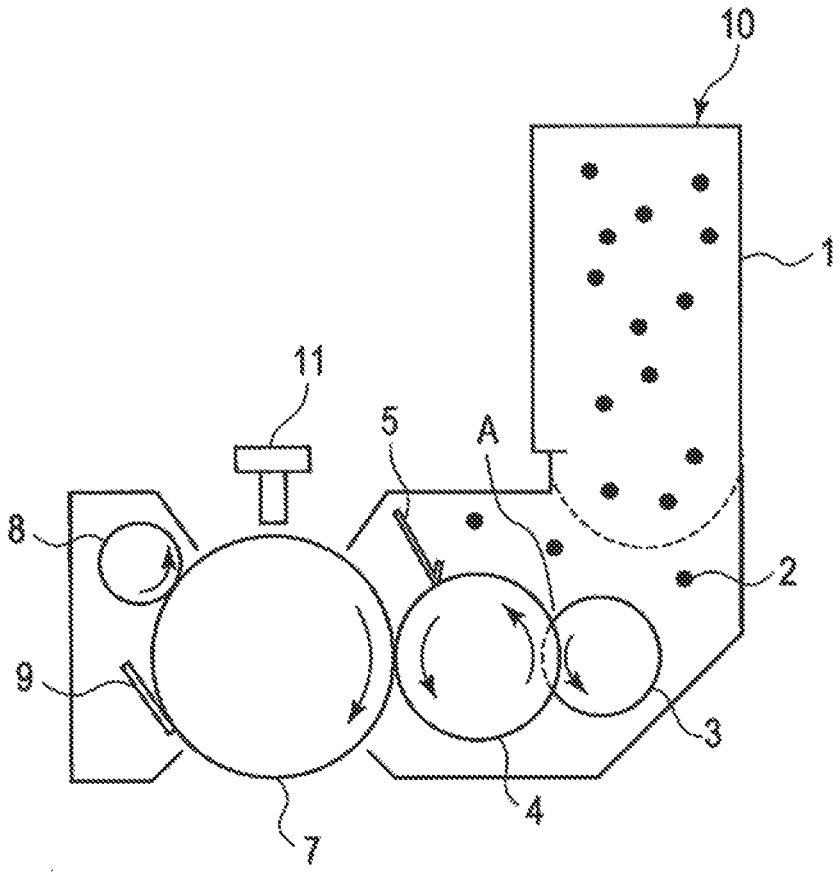
FIG. 3 is a diagram of a configuration of a development unit of the embodiment of the invention.

FIG. 3 is a diagram of the configuration of one development unit 10. The drawing includes its corresponding LED head 11 as light-exposure device.

Each development unit 10 includes; toner cartridge 1; supply roller 3 as a developer supplying member; development roller 4 as a developer carrier; development blade 5 as thin-film forming member; photosensitive drum 7 as an image carrier; charging roller 8 as charging device; and cleaning blade 9.

Toner cartridge 1 is filled with toner 2 as the developer, and is detachable from the main body part. As described later, toner 2 is formed by a pulverizing method in which: a composition mixture including a binder resin, a charge controlling agent, a coloring agent and a mold release agent is thermally melted and kneaded; and then the resultant composition mixture is pulverized. Toner 2 includes: a base material (base toner) made of a resin and wax; and external additives, such as silica and metal oxides, which are added around the base toner. These additives are added in order to prevent toner 2 from coming into direct contact with another member in the same manner as do rollers when toner 2 comes into contact with another toner and the surface of the development roller. Incidentally, the external additives are bonded to the base material due to van der Waals forces.

Supply roller 3 is configured to supply development roller 4 with toner 2 which drops from toner cartridge 1. Supply roller 2 is termed a sponge roller as well. Development blade 5 is formed from a plate metal whose extremity is bent, and meters a thin film of toner 2 which is supplied to the surface of development roller 4. Development roller 4 moves toner 2 to the electrostatic latent image formed on photosensitive drum 7 due to effects of an electric field. Incidentally, part of toner 2 exists around supply roller 3 when toner 2 drops from toner cartridge 1.

On the other hand, charging roller 8 electrostatically uniformly charges the surface of photosensitive drum 7. In photosensitive drum 7, a photosensitive layer (photoconductive insulating layer) made of an organic compound is formed around an aluminum raw tube. The diameter of photosensitive drum 7 is 29.95 mm. The photosensitive layer of photosensitive drum 7 has a property as an insulator when irradiated with no light. When irradiated with light, the photosensitive layer thereof has a property in which the photosensitive layer becomes conductive and thus discharges electrostatic charges. When corresponding LED head 11 irradiates photosensitive drum 7 with light, the negatively-charged surface layer is made to discharge electrostatic charges, and the electrostatic latent image is formed on photosensitive drum 7. In this event, for example, photosensitive drum 7, which is charged with a surface potential of −600V, is made to discharge electrostatic charges to a latent potential of −40V. In addition, the electrostatic latent image on photosensitive drum 7 is developed by development roller 4. Thus, as the developer image, a toner image is formed on photosensitive drum 7. For example, −200V is applied to development roller 4. Accordingly, negatively-charged toner 2 moves and adheres to the electrostatic latent image charged with −40V. Thus, the electrostatic latent image becomes visible.

Figure 4:
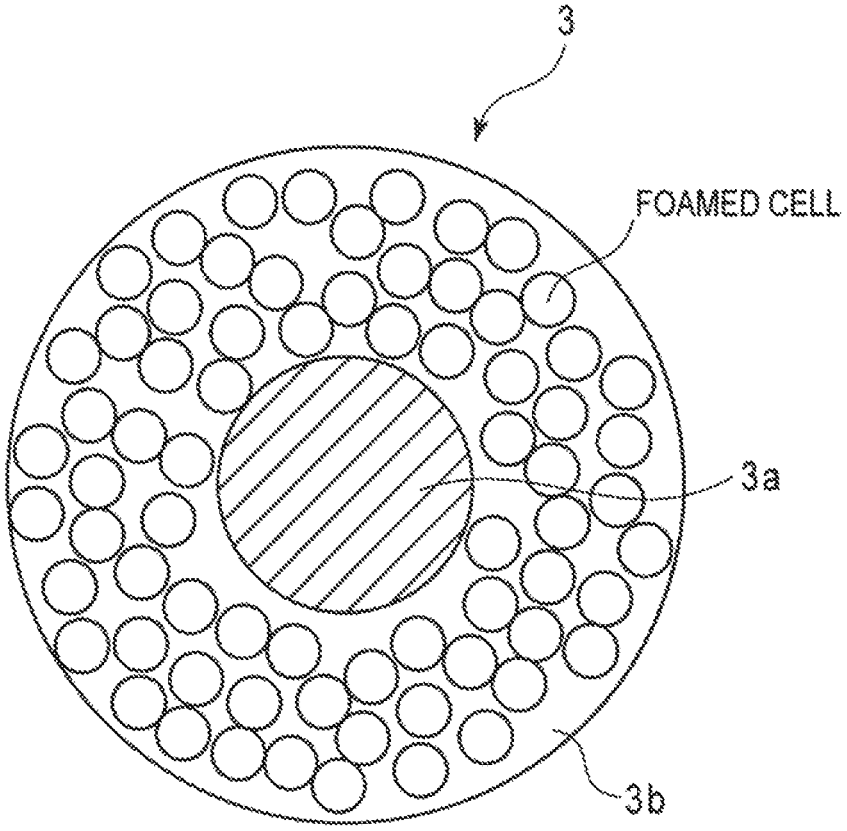
FIG. 4 is a cross-sectional view of a supply roller used in the development unit, which is taken along a plane perpendicular to an axial direction.

FIG. 4 is a cross-sectional view of supply roller 3 which is taken along a plane perpendicular to the axial direction of supply roller 3. Supply roller 3 is formed including metal core bar 3*a* and elastic layer 3*b*.

Supply roller 3 is a sponge roller having silicone foamed rubber around its metal core bar. The external diameter of supply roller 3 is 15.5 mm in the center, and 14.8 mm in the end portions. Supply roller 3 is shaped like a crown. The sizes of the respective foamed cells are measured by a CCD camera. To put it specifically, the size of each cell is an average value obtained from opening diameters of ten visibly-selected cells which appeared to have almost the same size. In addition, the opening diameter of each cell is obtained by: measuring the long and short diameters of the ellipse formed from the outer periphery of the cell; finding the area of the ellipse from the measurement result; and regarding the diameter of a complete round circle whose area is equal to the thus-found area as the opening diameter thereof. Furthermore, the enlargement of the diameter of each foamed cell can be achieved by doing things such as: increasing the amount of foaming agent; extending the time needed to cure the foamed rubber; or raising the temperature needed to cure the foamed rubber. It should be noted that supply roller 3 becomes more likely to be clogged with toner 2, and becomes harder, as the cell opening sizes of the respective foamed cells become smaller. On the other hand, supply roller 3 loses the capability of scraping residual toner from the surface of development roller 4 as the cell opening sizes thereof become larger. Moreover, a resistance value representing the resistance between elastic layer 3*b* and its opposed surface is adjusted by adding carbon black, as a conductive agent, to elastic layer 3*b*.

Figure 5:
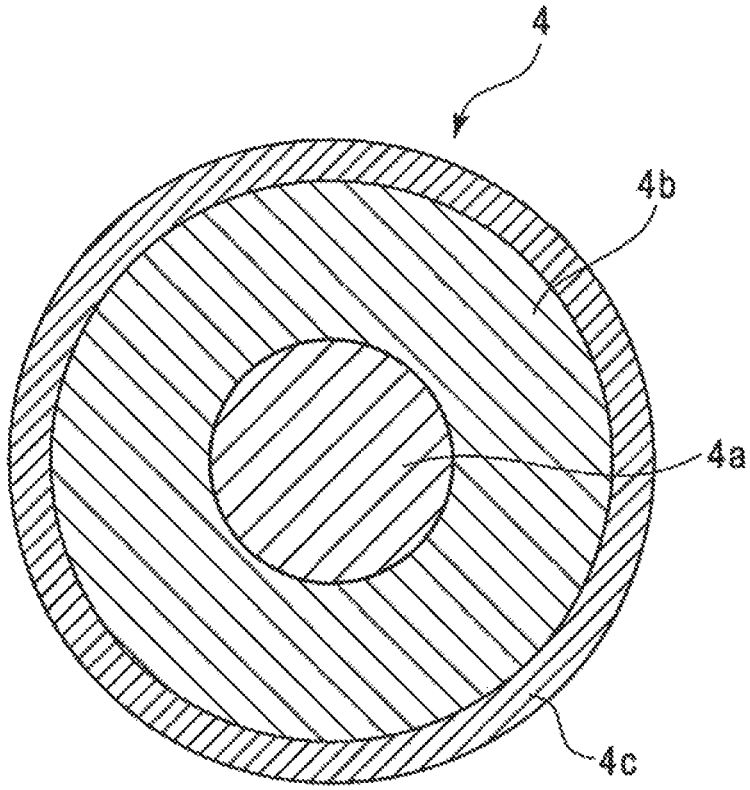
FIG. 5 is a cross-sectional view of a development roller used in the development unit, which is taken along a plane perpendicular to an axial direction.

FIG. 5 is a schematic cross-sectional view of development roller 4 which is taken along the plane perpendicular to the axial direction of development roller 4.

Development roller 4 is formed, coaxially including: metal core bar 4*a* made of steel whose surface is plated with nickel; elastic layer 4*b* made of a urethane rubber; and surface layer 4*c* made of an isocyanate on the surface of elastic layer 4*b*. The external diameter of development roller 4 is 19.6 mm. Incidentally, elastic layer 4*b* of development roller 4 is formed harder than elastic layer 3*b* of supply roller 3.

Development blade 5 is formed by stacking two 0.08 mm-thick stainless steel (SUS304B-TA) plates which are bent with a radius of 0.275 mm. As shown in FIG. 3, development blade 5 is placed in contact with development roller 4 with the short and long bent sides of development blade 5 located upstream and downstream, respectively, when viewed in the direction of the rotation of the development roller, as well as in a way that development blade 5 can deform with a certain linear pressure (of approximately 40 to 70 gf/cm).

Cleaning blade 9 is formed from a rubber member as an elastic body, and scrapes the residual toner image, which has not been transferred to the recording sheet, from photosensitive drum 7. To put it specifically, cleaning blade 9 is formed by bonding urethane rubber, as a blade, to the metal plate. A part of toner 2, which has not been transferred to recording sheet 14 and remains on the surface of photosensitive drum 7, is scraped by cleaning blade 9. After the printing operation is completed, scraped toner 2 is collected into waste developer tank 21 in accordance with a sequence determined by printer control unit 30.

Although not illustrated in FIG. 3, gears for transmitting drives to the rollers and photosensitive drum 7 are fixed to the rollers and photosensitive drum 7, respectively, by a press-fitting method or other method. In this respect, a gear fixed to photosensitive drum 7 is referred to as a drum gear; a gear fixed to development roller 4 is referred to as a development gear; a gear fixed to supply roller 3 is referred to as a sponge gear; a gear fixed to charging roller 8 is referred to as a charge gear; and a gear set between the development gear and the supply gear is referred to as an idle gear.

The rotational directions of the rollers and photosensitive drum 7 during the development process are as shown in FIG. 3, respectively. Particularly, supply roller 3, development roller 4, photosensitive drum 7 and charging roller 8 rotate in their own directions indicated by single-pointed arrows, respectively. Supply roller 3 and development roller 4, especially, rotate in their respective opposite directions in contact area A between supply roller 3 and development roller 4. For this reason, toner 2 remaining on development roller 4 is scraped by the sponge of supply roller 3 without moving from development roller 4 to photosensitive drum 7.

(Explanation of Operation)

Upon receiving a print instruction from printer control unit 30 (FIG. 2), the image forming apparatus shown in FIG. 1 first starts to make motor 38 rotate, and transmits a driving force to the drum gear via several gears (not illustrated), thus making photosensitive drum 7 rotate. Once the driving force is transmitted from the drum gear to the development gear, the development roller rotates. Once the driving force is transmitted from the development gear to the supply gear via the idle gear, supply roller 3 rotates. Once the driving force is transmitted from the drum gear to the charge gear, charging roller 8 rotates. Almost simultaneous with the start of the rotation of motor 38, the predetermined bias voltages are applied to development units 10 and transfer rollers 17 by bias voltage controller 33, and the halogen lamp of fixing unit 12 is heated to the predetermined fixing temperature.

The surface layer of photosensitive drum 7 is uniformly charged due to the voltage applied to charging roller 8 and the rotation of charging roller 8. Once a charged portion of photosensitive drum 7 comes under its corresponding LED head 11, LED head 11 emits light in accordance with an image to be printed, which has been sent to light-exposure controller 34 (FIG. 2) of printer control unit 30. Thereby, photosensitive drum 7 forms the electrostatic latent image on its surface, and functions as an electrostatic latent image carrier. Once its portion on which the electrostatic latent image is formed reaches the point of contact between photosensitive drum 7 and development roller 4, the thin film of toner 2 moves to the electrostatic latent image due to the difference in electric potential between the electrostatic latent image on photosensitive drum 7 and development roller 4. Thereby, the toner image obtained by making the electrostatic latent image become visible is formed on photosensitive drum 7. Accordingly, photosensitive drum 7 functions as the developer image carrier.

Example 1

Descriptions are hereinbelow provided for a method of manufacturing toner 2, a method of manufacturing supply roller 3, and the result of evaluation using image forming apparatus 100.

Supply roller 3 is manufactured as follows. A silicone rubber compound is prepared by mixing: 100 parts by weight of silicone rubber KE151U (which is the name of a product made by Shin-Etsu Chemical Co., Ltd.); 0.3 parts by weight of low-temperature degradable organic peroxide curing agent C-1 (which is the name of a product made by Shin-Etsu Chemical Co., Ltd.); 3 parts by weight of high-temperature degradable organic peroxide curing agent C-3 (which is the name of a product made by Shin-Etsu Chemical Co., Ltd.); and 9 parts by weight of organic foaming agent KEP-13 (which is the name of a product made by Shin-Etsu Chemical Co., Ltd.). Subsequently, an intermediate part is produced by extruding the silicone rubber compound onto the stainless steel core bar in a wrapped manner by use of an extrusion press. This intermediate part is subjected to a forming curing process by heating the intermediate part in an IR furnace at 200° C. for 30 minutes, and is thereafter subjected to a second curing process at 200° C. for four hours. Afterward, the skin layer is removed from the resultant intermediate part, and the value of the external diameter of the intermediate part is adjusted, by polishing the intermediate part with a cylindrical grinder. Thereby, supply roller 3 having foam, whose cell opening size is 300 μm, in its surface (hereinafter referred to as sponge roller a) is produced.

In this event, sponge roller 13 whose cell opening size is 600 μm, and sponge roller γ whose cell opening size is 900 μm are obtained by changing the amount of organic foaming agent KEP-13. Incidentally, for each of sponge rollers α, β, γ, the cell opening size S is obtained as an average value of the opening diameters of the respective 10 cells which are measured by a CCD camera.

It should be noted that an experiment is conducted on this example with the cell opening size S set in a range of 300 μm to 900 μm. That is because consideration is given to the fact that a stain takes place because: the cell openings become more likely to be clogged with toner 2 as the cell opening size S becomes smaller; and supply roller 3's capability of scraping toner 2 becomes worse as the cell opening size S becomes larger.

Subsequently, toner 2 is produced by use of a method (what is termed as a pulverizing method) which is described below.

A composition mixture is prepared by mixing; 100 parts by weight of polyester resin (with a number-average molecular weight of 3700, and a glass transition temperature (Tg) of 62° C.) as the binder resin; one part by weight of salicylic acid complex as the charge controlling agent; three parts by weight of phthalocyanine blue (C.I. Pigment Blue 15:3) as the coloring agent; and 10 parts by weight of a mold release agent (with a glass transition temperature (Tg) of 100° C.). This composition mixture is fully stirred and mixed in a mixer (a Henschel mixer manufactured by Mitsui-Miike Kakoki Co., Ltd.). Subsequently, the thus-obtained mixture is thermally melted and kneaded by an open-roll continuous kneader (a Kneadex manufactured by Mitsui Kozan Co., Ltd.) at a temperature of 100° C. for approximately three hours. Thereafter, the resultant mixture is cooled to room temperature. Afterward, the thus-obtained kneaded matter is pulverized by an impact-type pulverizer using a jet stream (a Dispersion Separator manufactured by Nippon Pneumatic MFG. Co., Ltd.), followed by classification by a wind-power rotor rotation dry-air classifier using centrifugal force (a Micron Separator manufactured by Hosokawa Micron Corporation). Thereby, the base toner is obtained.

100 parts by weight of the base toner is mixed with the following external additives by the Henschel mixer (manufactured by Mitsui-Miike Kakoki Co., Ltd.). The external additives are 1.0 part by weight of hydrophobic silica impalpable powder AEROSIL® R-972 (made by Nippon Aerosil Co.), 1.5 parts by weight of another hydrophobic silica impalpable powder AEROSIL® RY-50 (made by Nippon Aerosil Co.), and conductive granulated powder of titanium oxide. Subsequently, the mixture is sieved into toner A.

In this respect, toners C, E which are different in the volume mean particle diameter are also produced under different conditions (in terms of a length of time, a force and the like) for the pulverization process. Toners A, C, E are further sieved into toners B, D, F. Thus, a volume ratio of particles having a particle diameter of 5 μm or less to the total toner is lower in toners B, D, F than in toner A, C, E, respectively.

The volume mean particle diameter, and the volume ratio of particles having a particle diameter of 5 μm or less in each toner are measured by the Coulter Principle. The Coulter Principle is termed an electrical sensing zone method. The Coulter Principle is a method in which: a certain amount of electric current is made to flow through a narrow orifice (aperture) with a small diameter in an electrolytic solvent (an aqueous solution in which an electrolyte is dissolved, or an organic solvent); and change which takes place in the electric resistance of this system when particles pass the aperture is measured. In other words, the Coulter Principle employs a phenomenon in which the volume of part of the electrolytic solution in the aperture is replaced with the volume of particles passing through the aperture; and the volume of the replaced part of the electrolytic solution raises the electric resistance.

A specific measurement method is as follows. The measurement is carried out by a cell counter analyzer "Coulter Multisizer 3®" (manufactured by Beckman Coulter, Inc.), in which 30,000 particles passing through an aperture tube with a diameter of 100 μm are counted. Thereby, the volume mean particle diameter and the particle diameter distribution are obtained.

1. First of all, 5 g of Emulgen (produced by Kao Corporation) and 95 g of Isoton® (produced by Beckman Coulter, Inc.) are placed in a beaker, and are thermally melted while being stirred there by a stirrer.

2. One spoonful of a toner sample scooped by a micro spatula is mixed into 5 ml of the 5% Emulgen solution, and is dispersed in the solution by an ultrasonic disperser for 10 seconds.

3. 25 ml of Isoton® is added to this solution, and is dispersed in the solution by use of the ultrasonic dispersion for 60 seconds. Thereby, a sample to be measured is prepared.

4. The measurement cell of the multisizer is filled with the electrolytic solution (Isoton®), and it is made sure that the number of counted particles is 100 or less during a 30-second-long measurement.

5. The sample to be measured is added, and its concentration is adjusted in a way that the displayed concentration is approximately 10%.

6. After the measurement, a histogram representing the particle volume distribution is obtained. The volume mean particle diameter and the particle diameter distribution are read from the histogram on the basis of the display of particle diameters as converted to spherical diameters.

As for the measured volume mean particle diameter Dv, toners A, B are 7.2 μm, tonners C, D are 6.3 μm, and toners E, F are 5.7 μm. In addition, as for a volume ratio v of particles having a particle diameter of 5 μm or less to the total toner, toner A is 30.5%; toner B, 8.7%; toner C, 31.0%; toner D, 10.8%; toner E, 32.3%; and toner F, 25.4%.

It should be noted that examples of the impalpable powder mixed with the base toner include silica, alumina, titanium oxide, barium titanate, magnesium titanate, calcium titanate, strontium titanate, zinc oxide, silica sand, clay, mica, wollastonite, diatomaceous earth, chrome oxide, cerium oxide, colcothar, antimony trioxide, magnesium oxide, zirconium oxide, barium sulfate, barium carbonate, calcium carbonate, silicon carbide, and silicon nitride.

In addition, the impalpable powder of silica is impalpable powder of a substance having Si—O—Si bonding configurations. The impalpable power of silica may be produced by a dry method or a wet method. The impalpable powder may be made of any one of aluminum silicate, sodium silicate, potassium silicate, magnesium silicate, zinc silicate and the like instead of the anhydrous silicon dioxide. Otherwise, impalpable powder of silica or the like, on whose particles a surface treatment is performed by use of a silane-based coupling agent, a titanium-based coupling agent, a silicone oil, another silicone oil having an amine-containing side chain and the like, may be used instead.

Sponge rollers α to γ and toners A to F, which are produced in the above-described manner, are combined as shown in FIG. 6 (Example 1).

In Comparative Example 1-1, toner A is placed in a development unit in which sponge roller α is installed.

In Example 1-1, toner B is placed in a development unit in which sponge roller α is installed.

In Examples 1-2 to 1-5, toners A, B are placed in development units in which sponge rollers β, γ are installed.

In Comparative Example 1-2, toner C is placed in a development unit in which sponge roller α is installed.

In Example 1-6, toner D is placed in a development unit in which sponge roller α is installed.

In Examples 1-7 and 1-8, toners C, D are placed in development units in which sponge roller β is installed.

In Comparative Examples 1-3 and 1-4, toners C, D are placed in development units in which sponge roller γ is installed.

In Comparative Example 1-5, toner E is placed in a development unit in which sponge roller α is installed.

In Example 1-9, toner F is placed in a development unit in which sponge roller α is installed.

In Examples 1-10 and 1-11, toners E, F are placed in development units in which sponge roller β is installed.

In Comparative Examples 1-6 and 1-7, toners E, F are placed in development units in which sponge roller γ is installed.

Subsequently, in the following manner, a continuous printing test for evaluation is performed on an A-4 size sheet by an image processing apparatus to which a development unit including toner 2 and supply roller 3 is attached, while changing the volume mean particle diameter Dv and the volume ratio v of particles having a particle diameter of 5 μm or less in toner 2 and changing the cell opening size S of supply roller 3.

1. 300 g of a toner is placed inside toner cartridge 1.

2. Development unit 10 in which toner cartridge 1 is installed is installed in the image forming apparatus. Subsequently, a 0.3%-concentration image is printed on 40,000 recording sheets at normal temperature in a repeated 3 P/J sequence in which the printer stops each time the image forming apparatus finishes printing the image on three consecutive recording sheets.

FIG. 6 (Example 1) shows the result of a visual check for the presence or absence of a stain on the continuously-printed images. In FIG. 6, reference sign "o" means that no stain is observed on the images, while reference sign "x" means that a stain is observed on the images. The term "stain" used here is defined as the phenomenon in which: as the scraping performance of the sponge roller becomes worse with a lapse of time, the amount of toner on the development roller becomes larger, and the total amount of charge accordingly becomes excessive; as a resultant, a part of the toner on the developer carrier is transferred to the electrostatic latent image carrier, and is developed on the electrostatic latent image carrier, irrespective of the difference in electric potential between the developer carrier and the electrostatic latent image in electrophotographic process; and appears on the image.

The stain takes place in Comparative Example 1-1.

The images including no stain are obtained from Examples 1-1 to 1-5.

The stain takes place in Comparative Example 1-2.

The images including no stain are obtained from Examples 1-6 to 1-8.

The stain takes place in Comparative Examples 1-3 to 1-5.

The images including no stain are obtained from Examples 1-9 to 1-11.

The stain takes place in Comparative Examples 1-6 to 1-7.

(Explanation of Effects)

Attention is paid to relationships between the volume mean particle diameter Dv, the volume ratio v of particles having a particle diameter of 5 μm or less, and the cell opening size S in both the cases where no stain takes place and where a stain takes place. It is found that in the case where no stain takes place, the following relationships exist:

$v<S/10$ and $S/Dv\leq125$.

From these relationships, one may consider that: in a case where particles having the small particle diameter of 5 μm or less are large in number, the cell openings are highly likely to be clogged; and in a case where the particle diameters of the toner particles are too small in comparison with the diameters of the cell openings, the cells are highly likely to be clogged as well.

Second Embodiment (Description of Configuration)

Toners used in Second Embodiment are different from the toners used in First Embodiment, although the configurations of the image forming apparatus and development units used in Second Embodiment are the same as in First Embodiment. Second Embodiment uses toners which are produced by use of what is termed a polymerization method. In this respect, the polymerization method is that in which a base toner obtained by mixing and flocculating a copolymer resin, a coloring agent and a wax is used.

Example 2

Toners are produced in accordance with the following method.

A styrene acrylic copolymer resin is obtained from a styrene, an acrylic acid and a methyl methacrylate in an aqueous solvent, and the styrene acrylic copolymer is made into primary particles. In addition, phthalocyanine blue (C.I. Pigment Blue 15:3) is used as the coloring agent. Furthermore, stearyl stearate selected from higher fatty acid ester-based waxes is used as the wax. The base toner is obtained by mixing and flocculating these ingredients. 100 parts by weight of the base toner is mixed with 0.7 part by weight of hydrophobic silica impalpable powder AEROSIL® R-972 (made by Nippon Aerosil Co.), 1.7 parts by weight of another hydrophobic silica impalpable powder AEROSIL® RY-50 (made by Nippon Aerosil Co.), and conductive granulated powder of titanium oxide by use of the Henschel mixer (manufactured by Mitsui Kozan Co., Ltd.). Subsequently, the mixture is sieved into toner G. In this respect, toners I, K which are different in the volume mean particle diameter are also produced under different conditions (in terms of a length of time, a heat and the like) for the flocculation process. Toners G, I, K are further sieved into toners H, J, L. Thus, a volume ratio of particles having a particle diameter of 5 μm or less to the total toner is lower in toners H, J, L than in toner G, I, k, respectively.

As for the measured volume mean particle diameter Dv, toners G, H are 7.3 μm, tonners I, J are 6.0 μm, and toners K, L are 5.5 μm in. In addition, as the volume ratio v of particles having a particle diameter of 5 μm or less, toner G is 30.2%; toner H, 8.5%; toner I, 30.9%; toner J, 11.3%; toner K, 31.5%; and toner L, 22.1%.

Toners G to L, which are produced in the above-described manner, are combined as shown in FIG. 7 (Example 2).

In Comparative Example 2-1, toner G is placed in a development unit in which sponge roller α is installed.

In Example 2-1, toner H is placed in a development unit in which sponge roller α is installed.

In Examples 2-2 to 2-5, toners G, H are placed in development units in which sponge rollers β, γ are installed.

In Comparative Example 2-2, toner I is placed in a development unit in which sponge roller α is installed.

In Example 2-6, toner J is placed in a development unit in which sponge roller α is installed.

In Examples 2-7 and 2-8, toners I, J are placed in development units in which sponge roller β is installed.

In Comparative Examples 2-3 and 2-4, toners I, J are placed in development units in which sponge roller γ is installed.

In Comparative Example 2-5, toner K is placed in a development unit in which sponge roller α is installed.

In Example 2-9, toner L is placed in a development unit in which sponge roller a is installed.

In Examples 2-10 and 2-11, toners K, L are placed in development units in which sponge roller β is installed.

In Comparative Examples 2-6 and 2-7, toners K, L are placed in development units in which sponge roller γ is installed.

(Explanation of Operation)

Evaluation is made on each of the foregoing configurations through a continuous printing operation as in the case of Example 1. FIG. 7 shows a result of the evaluation.

The stain takes place in Comparative Example 2-1.

The images including no stain are obtained from Examples 2-1 to 2-5.

The stain takes place in Comparative Example 2-2.

The images including no stain are obtained from Examples 2-6 to 2-8.

The stain takes place in Comparative Examples 2-3 to 2-5.

The images including no stain are obtained from Examples 2-9 to 2-11.

The stain takes place in Comparative Examples 2-6 to 2-7.

(Explanation of Effects)

It is found that in Examples 2-1 to 2-11 where images including no stain are obtained, the following relationships exist as in the case of Example 1:

$v<S/10$ and $S/Dv\leq125$.

In short, one may consider that the two above-mentioned inequalities do not depend on which method is employed to produce the toners.

As described with regard to the first and second embodiments, better images can be obtained by using the image forming apparatus satisfying the relationships expressed by $v<S/10$ and $S/Dv\leq125$.

To put it the other way round, one may consider that the use of an image forming apparatus which does not satisfy the relationships makes the cell openings of the sponge roller (developer supplying member) likely to be clogged with the developer. However, as in the case of the foregoing embodiments, the use of the image forming apparatus satisfying the relationships expressed by $v<S/10$ and $S/Dv\leq125$ makes the cell openings of the sponge roller (developer supplying member) to be clogged with the developer, and makes it possible to obtain better images.

(Explanation of Use Modes)

Each embodiment is described by use of an example in which the embodiment is applied to the printer. However, the application of each embodiment is not limited to the printer. Each embodiment can be applied to facsimile machines, copying machines and the like which use the electrophotography.

In addition, the kinds and amounts of the raw materials (for example, the binder resin, the charge controlling agent and the coloring agent) of the base toner, the kinds and amounts of the impalpable powders (for example, silica and titanium oxide) mixed with the base toner, the materials and the like of the developer and sponge rollers, which are mentioned with regard to Examples 1 and 2, are shown as just their respective examples. Even if other materials are used, the use does not influence the effects as long as the relationships expressed with $v<S/10$ and $S/Dv\leq125$ are satisfied.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. A development unit comprising:

a developer container portion having a developer therein;

a developer carrier configured to carry the developer, and capable of supplying the carried developer to an electrostatic latent image; and a developer supplying member configured to supply the developer to the developer carrier, the developer supplying member comprising a surface thereof made of a foamed body, wherein relationships expressed by $v<S/10$ and $S/Dv\leq125$ are satisfied, where a cell opening size of the foamed body is S[μm], a volume mean particle diameter of the developer is Dv[μm], and a volume ratio of particles having a particle diameter of 5[μm] or less to the total developer is v[%].

2. The development unit of claim 1, wherein the cell opening size of the foamed body is 300 μm to 900 μm.

3. The development unit of claim 1, wherein the volume mean particle diameter of the developer is 5.5 μm to 7.3 μm.

4. The development unit of claim 1, wherein the developer carrier and the developer supplying member are in contact with each other in a contact area.

5. The development unit of claim 4, wherein the developer supplying member and the developer carrier rotate in directions opposite to each other in the contact area.

6. The development unit of claim 1, wherein the developer supplying member is a roller.

7. The development unit of claim 1, wherein the developer supplying member includes a shaft, and a foamed elastic layer provided to the external peripheral surface of the shaft.

8. The development unit of claim 7, wherein the foamed elastic layer is made of a rubber obtained by foaming silicone.

9. The development unit of claim 8, wherein the developer is a toner including at least a binder resin.

10. The development unit of claim 9, wherein the developer is obtained by thermally melting and kneading together the binder resin and a composition mixture which includes a charge controlling agent, a coloring agent and a mold release agent, and by pulverizing the resultant composition mixture.

11. The development unit of claim 9, wherein the developer is obtained by flocculating the binder resin, a charge controlling agent, a coloring agent and a mold release agent.

12. The development unit of claim 9, wherein the toner is formed by a pulverizing method in which a composition mixture including a binder resin, a charge controlling agent, a coloring agent, and a mold release agent are thermally melted and kneaded, and then the resultant composition mixture is pulverized.

13. The development unit of claim 1, further comprising an image carrier capable of carrying an electrostatic latent image, wherein the developer carrier forms a developer image on the image carrier by supplying the developer carried by the developer carrier to the electrostatic latent image carried on the image carrier.

14. An image forming apparatus comprising the development unit of claim 1.

15. The development unit of claim 1, wherein the developer includes silica powder and titanium powder mixed with a base toner.

16. The development unit of claim 1, wherein relationships expressed by $8.7<v<32.3$, $v<S/10$ and $S/Dv\leq125$ are satisfied, and wherein the developer is a toner that is formed by a pulverizing method.

17. The development unit of claim 1, wherein relationships expressed by $8.5<v<31.5$, $v<S/10$ and $S/Dv\leq123.3$ are satisfied, and wherein the developer is a toner that is formed by a polymerization method.

18. The development unit of claim 17, wherein the toner is formed by the polymerization method in which a base toner is obtained by mixing and flocculating a copolymer resin, a coloring agent, and a wax.

* * * * *